US011794235B2

(12) United States Patent
Yen

(10) Patent No.: US 11,794,235 B2
(45) Date of Patent: Oct. 24, 2023

(54) BUTTON BADGE MAKING MACHINE

(71) Applicant: Chin-Wen Yen, Tainan (TW)

(72) Inventor: Chin-Wen Yen, Tainan (TW)

( * ) Notice: Subject to any disclaimer, the term of this patent is extended or adjusted under 35 U.S.C. 154(b) by 379 days.

(21) Appl. No.: 17/039,663

(22) Filed: Sep. 30, 2020

(65) Prior Publication Data

US 2021/0353007 A1 Nov. 18, 2021

(30) Foreign Application Priority Data

May 18, 2020 (TW) ..... 109206061

(51) Int. Cl.
*B21J 13/00* (2006.01)
*B21D 22/06* (2006.01)

(52) U.S. Cl.
CPC ..... *B21J 13/00* (2013.01); *B21D 22/06* (2013.01)

(58) Field of Classification Search
CPC . A44B 1/06; B21J 13/00; B21D 22/06; B21D 22/08; B21D 22/10; B21D 22/24; B21D 22/26; B21D 37/06
USPC ..... 72/470, 474, 475; 40/1.5, 616; 73/3, 4
See application file for complete search history.

(56) References Cited

U.S. PATENT DOCUMENTS 644,645 A * 3/1900 Silsby ..... B21D 53/48 79/4
3,643,530 A * 2/1972 Roebuck ..... A44B 1/06 79/5
6,279,445 B1 * 8/2001 Rosene ..... B21D 28/12 83/552
6,393,686 B1 * 5/2002 BRaunberger ..... B21D 53/48 79/4
7,509,891 B2 * 3/2009 Miyake ..... A44B 1/126 79/3

* cited by examiner

*Primary Examiner* — Adam J Eiseman
*Assistant Examiner* — Fred C Hammers
(74) *Attorney, Agent, or Firm* — Hamre, Schumann, Mueller & Larson, P.C.

(57) ABSTRACT

A button badge making machine includes a support frame and a lower die. The support frame includes a lower support member and first and second resilient units projecting upwardly from the lower support member and respectively having upwardly facing first and second support surfaces. The lower die includes a lower center die seat disposed on the lower support member, and a lower peripheral die seat surrounding and movable relative to the lower center die seat. The lower peripheral die seat is turnable about a rotating axis relative to the lower support member between first and second angular positions to be supported by the first and second support surfaces, respectively, with different resilient supports.

11 Claims, 14 Drawing Sheets

BUTTON BADGE MAKING MACHINE

CROSS-REFERENCE TO RELATED APPLICATION

This application claims priority of Taiwanese Patent Application No. 109206061, filed on May 18, 2020.

FIELD

The disclosure relates to a button badge making machine, and more particularly to a manually-operable button badge making machine.

BACKGROUND

A conventional button badge making machine generally includes two lower dies and an upper die to perform two steps of making a button badge. The lower dies are resiliently supported on a slide seat which is slidable such that each lower die is aligned uprightly with the upper die to perform the corresponding making step. Each lower die has a center die seat and a peripheral die seat surrounding and uprightly movable relative to the center die seat. The peripheral die seats of the two lower dies are resiliently movable along two different paths and with two different resilient forces so as to provide two different press strokes for the two making steps. The first making step needs a longer press stroke and the second making step needs a shorter press stroke. However, with the two lower dies, the conventional button badge making machine has a relatively large number of component parts, and is therefore costly to manufacture. With the need of making a variety of different sizes of button badges, it is required to replace all component parts of the upper and lower dies, which causes a high replacement cost and inconvenience for making the button badges. Moreover, only one lower die may be designed to perform a selected one of two different press strokes. However, the press force for the first making step will be too large if the spring force is set to fit the second making step, while the press force for the second making step will be too small if the spring force is set to fit the first making step.

SUMMARY

Therefore, an object of the disclosure is to provide a button badge making machine that can alleviate at least one of the drawbacks of the prior art.

According to the disclosure, the button badge making machine includes a support frame, a lower die and an upper die. The support frame includes a lower support member, an upper pressing member which is disposed above and movable relative to the lower support member in an upright direction, and a first resilient unit and a second resilient unit which extend in the upright direction and project upwardly from the lower support member. The first resilient unit has at least one first support surface which faces upwardly. The second resilient unit has at least one second support surface which faces upwardly. The first and second support surfaces are resiliently movable downwardly relative to the lower support member. The lower die includes a lower center die seat which is disposed and supported on the lower support member, and a lower peripheral die seat which surrounds and is movable relative to the lower center die seat in the upright direction for holding an upper body and a pattern layer of a button badge to be made in a first making step. The lower center die seat is adapted for holding a lower body in a second making step. The lower peripheral die seat is turnable relative to the lower support member about a rotating axis between a first angular position, where the lower peripheral die seat is engaged with and supported on the first support surface, and a second angular position, where the lower peripheral die seat is engaged with and supported on the second support surface. The upper die cooperates with the lower die to press and make the button badge. The upper die includes an upper center die seat which is disposed on and movable with the upper pressing member and which is correspondingly located above the lower center die seat, and an upper peripheral die seat which surrounds and is movable relative to the upper center die seat in the upright direction and which is correspondingly located above the lower peripheral die seat. The upper peripheral die seat is turnable relative to the upper pressing member about the rotating axis between a third angular position, where the upper peripheral die seat corresponds with the lower peripheral die seat in the first angular position and is movable with the upper center die seat downwardly toward the lower peripheral die seat to perform the first making step so as to press the upper body and the pattern layer together and transfer the upper body and the pattern layer to the upper die against a first counteracting force generated as a result of a first downward resilient movement of the lower peripheral die seat and the first support surface, and a fourth angular position, where the upper peripheral die seat corresponds with the lower peripheral die seat in the second angular position, and is movable relative to the upper center die seat in the upright direction to permit a downward movement of the upper center die seat and the upper pressing member relative to the upper peripheral die seat to perform a removal sub-step of the second making step so as to remove the assembled upper body and pattern layer from the upper die back to the lower peripheral die seat, and where the upper peripheral die seat is movable with the upper center die seat downwardly toward the lower peripheral die seat to perform a pressing sub-step of the second making step so as to press the lower peripheral die seat against a second counteracting force that is generated as a result of a second downward resilient movement of the lower peripheral die seat with the second support surface and that is greater than the first counteracting force.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
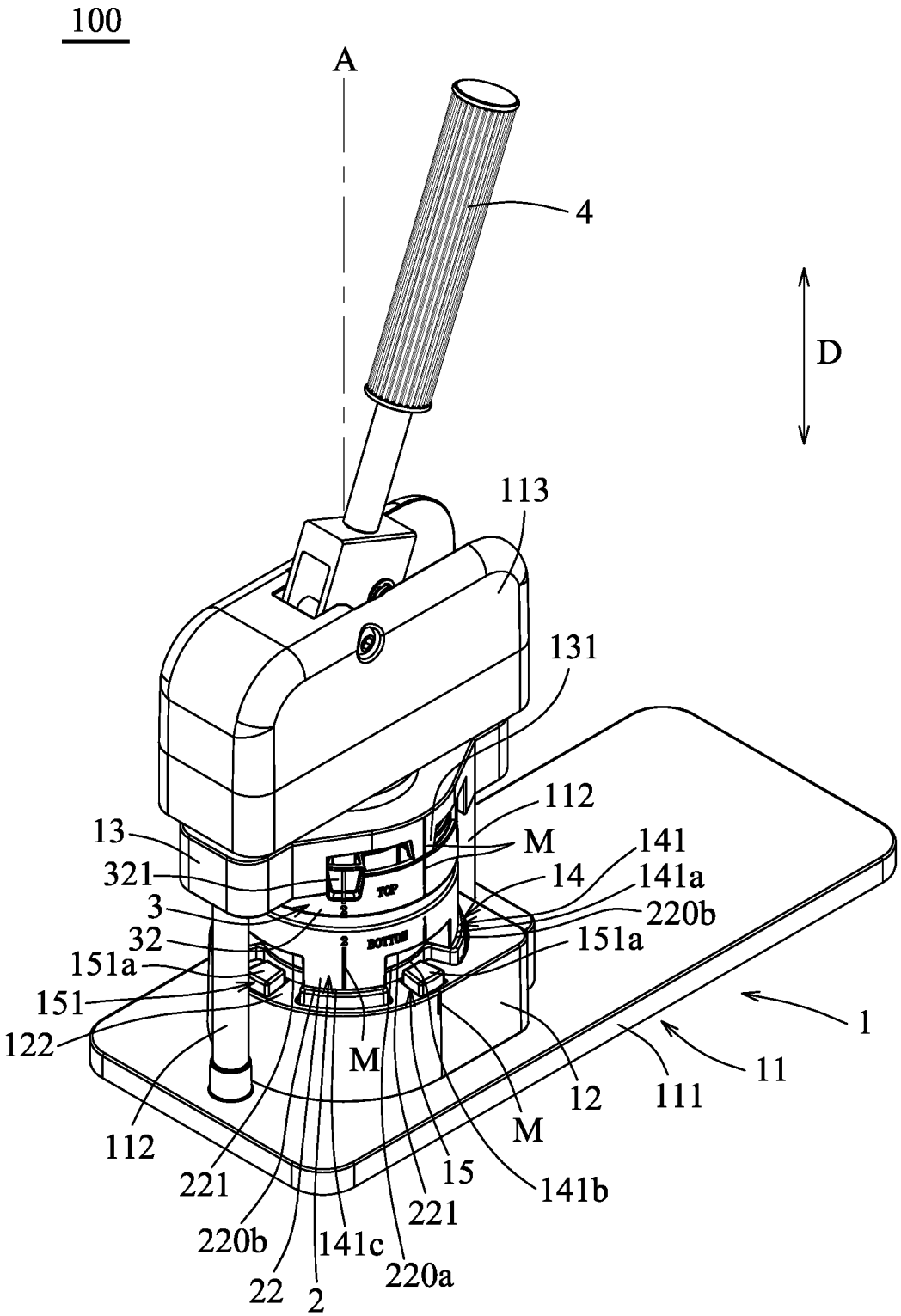
FIG. 1 is a perspective view illustrating an embodiment of a button badge making machine according to the disclosure, in a state where a lower peripheral die seat is in a first angular position and an upper peripheral die seat is in a third angular position.
Figure 2:
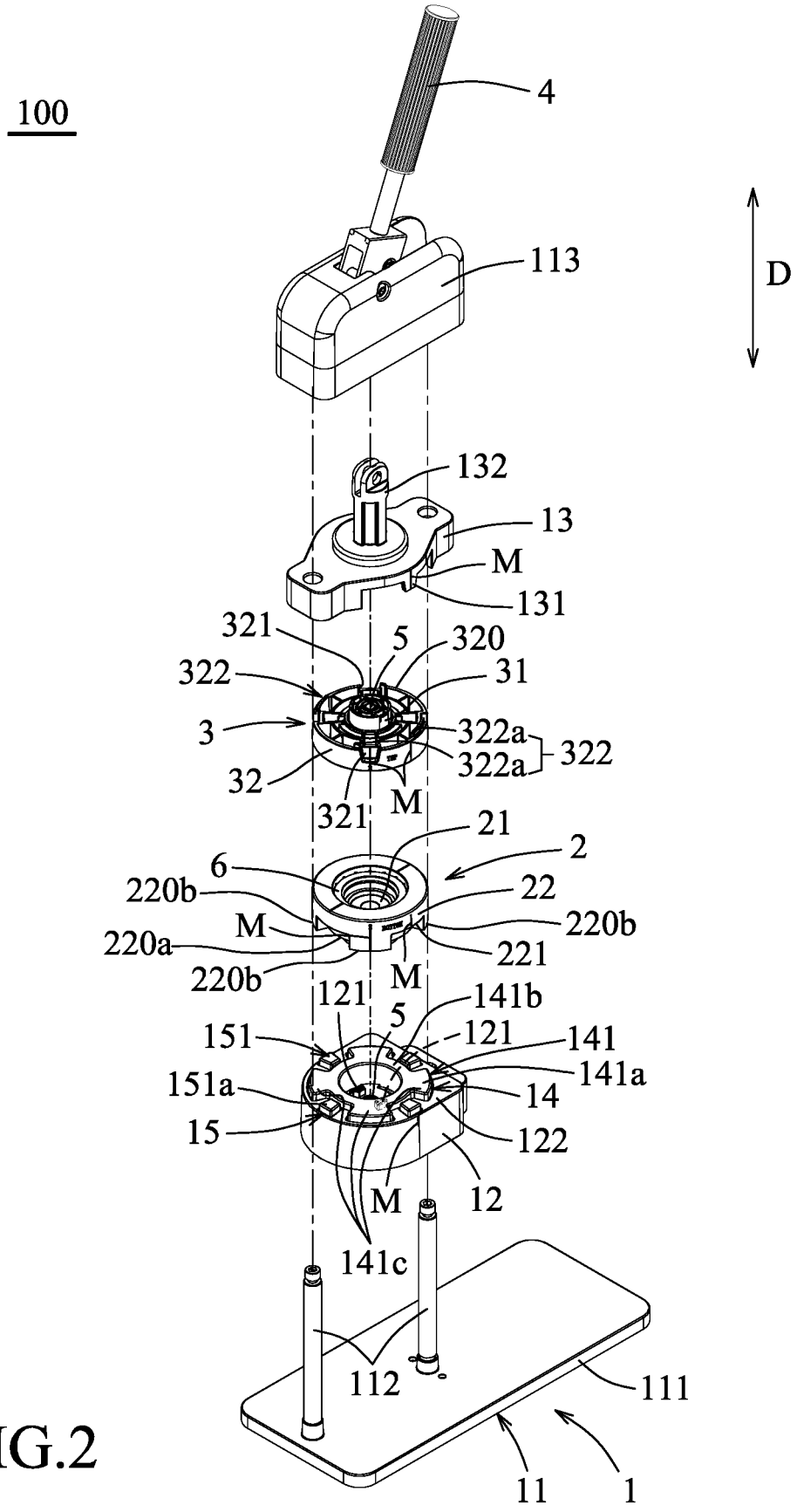
FIG. 2 is an exploded perspective view of the embodiment.
Figure 3:
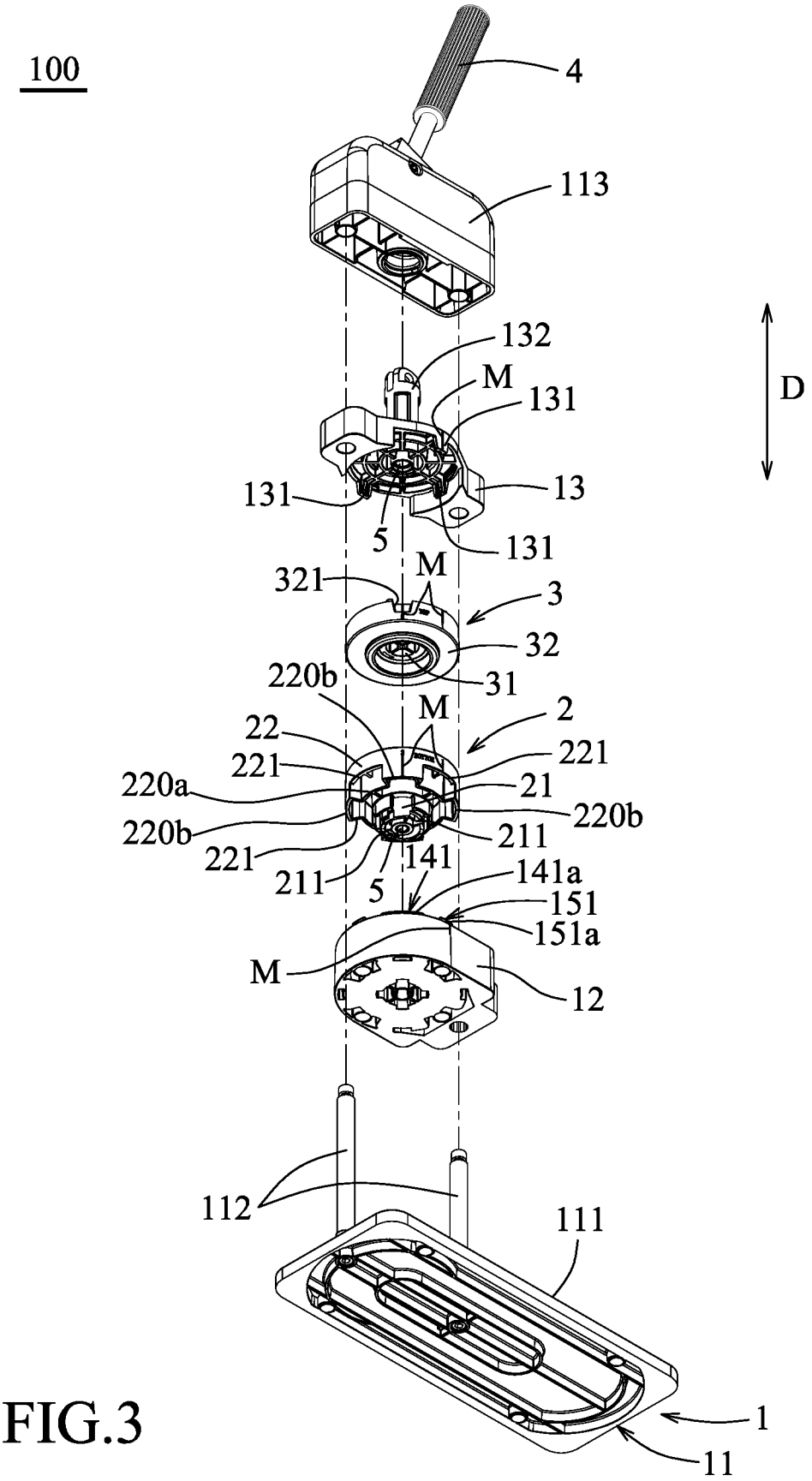
FIG. 3 is an exploded perspective view of the embodiment taken from another angle.

Referring to FIGS. 1 to 3, an embodiment of a button badge making machine 100 according to the disclosure is adapted to make a button badge 200 (see FIG. 14) which includes an upper body 201 (see FIG. 14), a pattern layer 202 (see FIG. 14) and a lower body 203 (see FIG. 14) superimposed upon one another. The button badge making machine 100 includes a support frame 1, a lower die 2, an upper die 3 and a handle 4.

Figure 4:
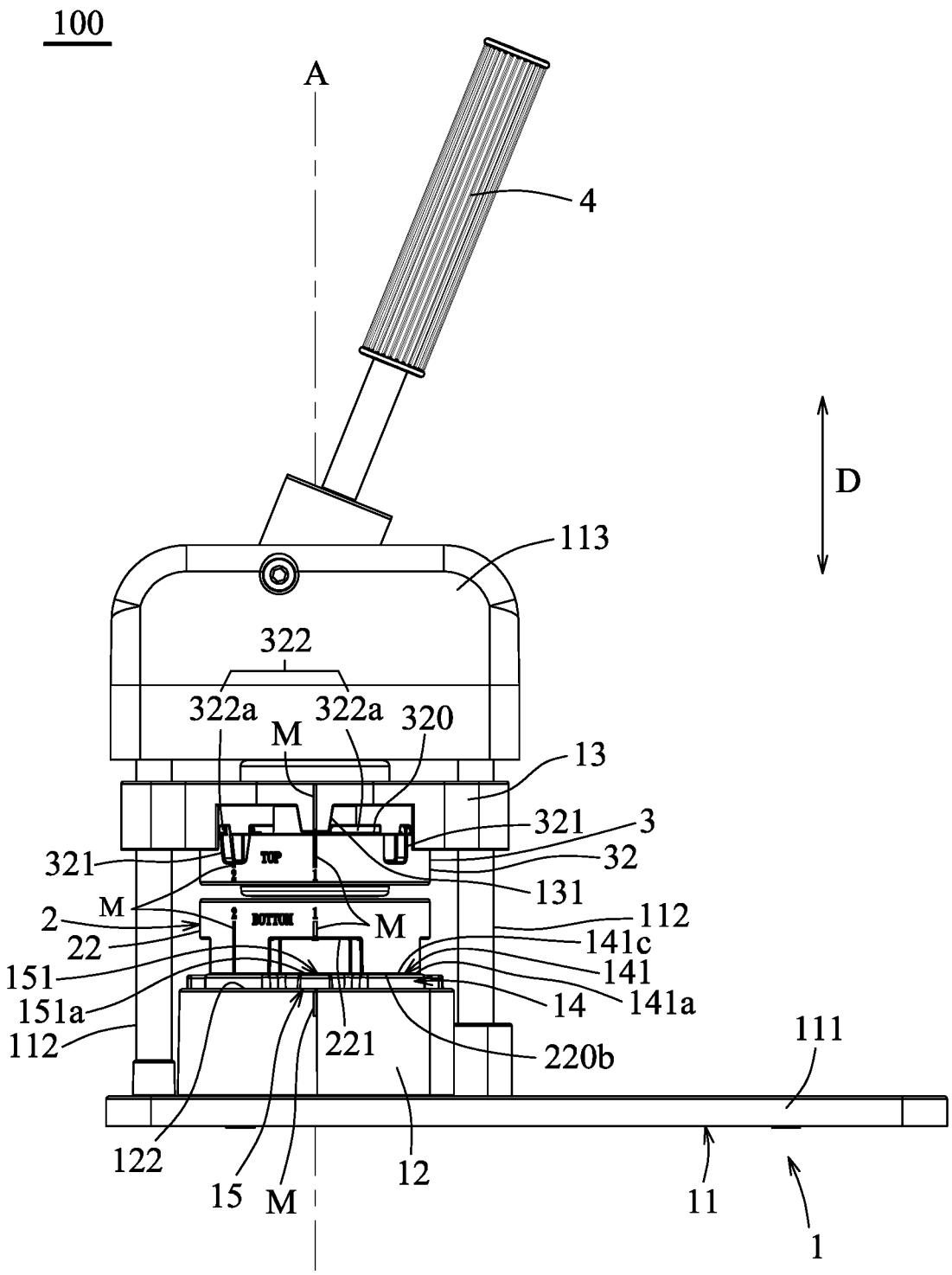
FIG. 4 is a front view of the embodiment in a state similar to FIG. 1.
Figure 5:
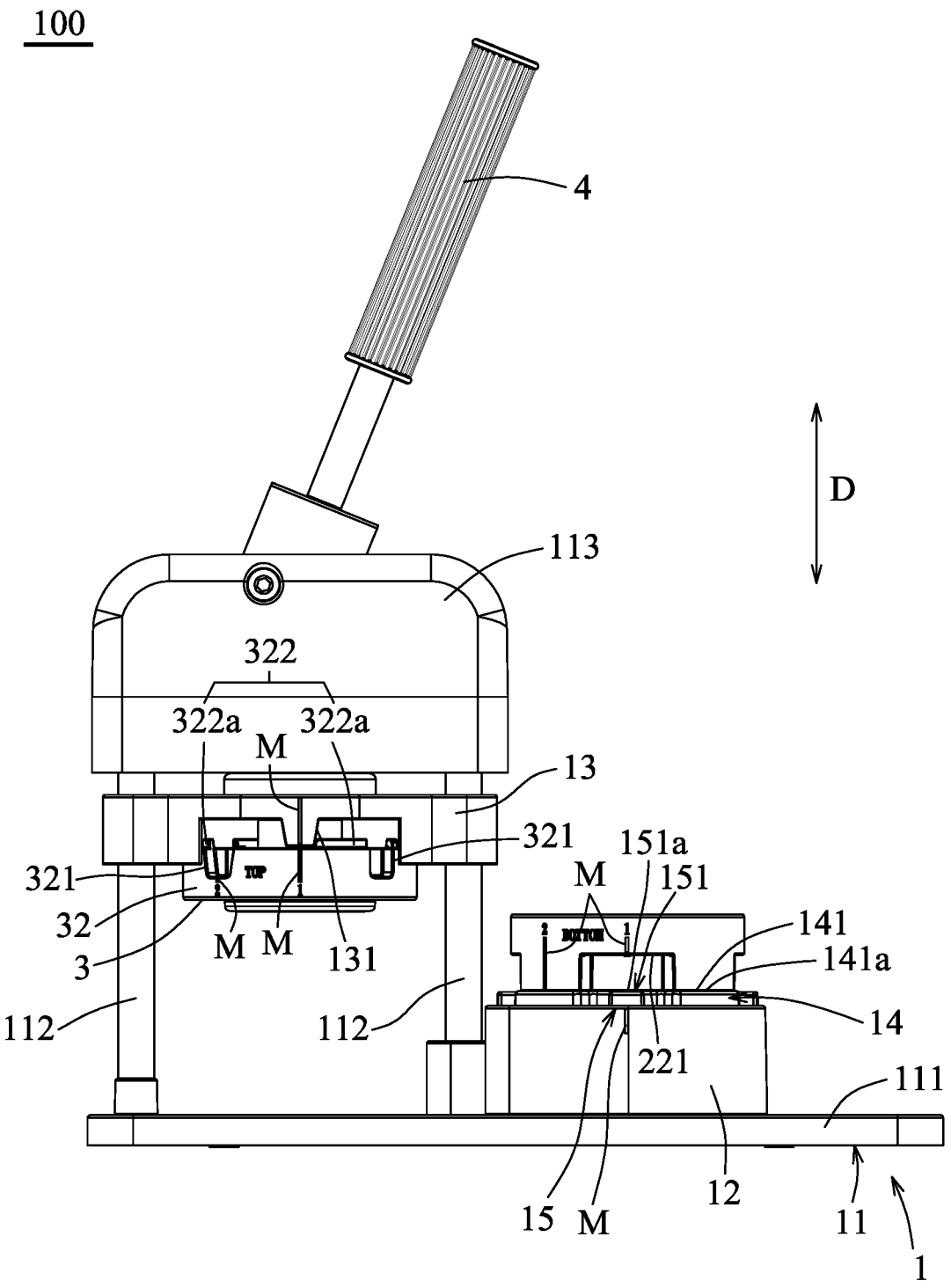
FIG. 5 is a front view of the embodiment in a state where a lower support member is turned to a right side.

With reference to FIGS. 1, 2, 4 and 5, the support frame 1 includes a main frame body 11, a lower support member 12 and an upper pressing member 13. The main frame body 11 includes a base plate 111, an upper frame portion 113 disposed above the base plate 111, and a plurality of upright posts 112 each extending in an upright direction (D) and interconnecting the base plate 111 and the upper frame portion 113. The lower support member 12 is rotatably journalled on one of the upright posts 112 at a lower end thereof (as shown in FIGS. 4 and 5). The upper pressing member 13 is slidably disposed on the upright posts 112 to be slidable in the upright direction (D) relative to the lower support member 12 and above the lower support member 12. In a modified embodiment, the main frame body 11 may be omitted.

Referring to FIGS. 1, 2, 3 and 6, a first resilient unit 14 and a second resilient unit 15 extend in the upright direction (D) and project upwardly from an upper surface 122 of the lower support member 12. The first resilient unit 14 has a first support protrusion 141 projecting upwardly of the lower support member 12, and a plurality of first biasing members 142 each connected between the lower support member 12 and the first support protrusion 141. The first support protrusion 141 has a first support surface (141*a*) which faces upwardly. The second resilient unit 15 has a plurality of second support protrusions 151 each projecting upwardly of the lower support member 12, and a plurality of second biasing members 152 each connected between the lower support member 12 and a respective one of the second support protrusions 151. Each second support protrusion 151 has a second support surface (151*a*) which faces upwardly. With the biasing action of the first and second biasing members 142, 152, the first and second support surfaces (141*a*, 151*a*) are resiliently movable downwardly relative to the lower support member 12. In this embodiment, the first and second biasing members 142, 152 are biasing springs. In a modified embodiment, the first and second support protrusions 141, 151 may be omitted, and the first and second support surfaces (141*a*, 151*a*) may be formed on the first and second biasing members 142, 152, respectively.

With reference to FIGS. 1, 2, 6 and 7, the lower die 2 includes a lower center die seat 21 which is disposed and supported on the lower support member 12, and a lower peripheral die seat 22 which surrounds and is movable relative to the lower center die seat 21 in the upright direction (D). The lower peripheral die seat 22 is revolvable relative to the lower support member 12 about a rotating axis (A) in the upright direction (D) between a first angular position (see FIG. 1) and a second angular position (see FIG. 7). In the first angular position, the lower peripheral die seat 22 is engaged with and supported on the first support surface (141*a*). In the second angular position, the lower peripheral die seat 22 is engaged with and supported on the second support surfaces (151*a*). The lower peripheral die seat 22 is adapted for holding the upper body 201 and the pattern layer 202 in the beginning of a first making step (see FIG. 10). The lower center die seat 21 is adapted for holding the lower body 203 in a second making step (see FIG. 12). Specifically, the required resilient support of the lower peripheral die seat 22 in the first angular position is larger than that in the second angular position when the bottom of lower peripheral die seat 22 is at the height of the upper surface 122 of the lower support member 12. In this embodiment, when the lower peripheral die seat 22 is in the second angular position, the lower peripheral die seat 22 is also engaged with and supported on the first support surface (141*a*). That is, the lower peripheral die seat 22 is supported on both the first and second support surfaces (141*a*, 151*a*) to enlarge the resilient support in the second angular position of the lower peripheral die seat 22, as shown in FIG. 2, and this will be described in greater detail in the succeeding paragraphs. In a modified embodiment, the lower peripheral die seat 22 may be engaged with and supported on only the second support surfaces (151*a*) which can provide larger support force on their own in the second angular position.

Referring to FIGS. 1, 2, 3 and 7, specifically in this embodiment, the first support surface (141*a*) has a major surface portion (141*b*) and a plurality of radially extending surface portions (141*c*) which are integrally formed with and extend radially and outwardly from the major surface portion (141*b*). The second support surfaces (151*a*) surround the major surface portion (141*b*). Each of the second support surfaces (151*a*) is located between two adjacent ones of the radially extending surface portions (141*c*). The lower peripheral die seat 22 has a major bottom portion (220*a*) which faces the major surface portion (141*b*) of the first support surface (141*a*), and a plurality of abutting protrusions (220*b*) which extend radially and outwardly from the major bottom portion (220*a*). The lower peripheral die seat 22 has a plurality of leeway slots 221 each formed among the major bottom portion (220*a*) and the abutting protrusions (220*b*) and corresponding with the respective second support surface (151*a*). In this embodiment, the major surface portion (141*b*) is annular in shape and substantially corresponds with the major bottom portion (220*a*). When the lower peripheral die seat 22 is in the first angular position (see FIG. 1), the major bottom portion (220*a*) is superimposed upon and abuts against the major surface portion (141*b*) in the upright direction (D), the abutting protrusions (220*b*) respectively abut against the radially extending surface portions (141*c*) in the upright direction (D), and the leeway slots 221 are respectively aligned with the second support surfaces (151*a*) in the upright direction (D) such that the lower peripheral die seat 22 is supported on only the first support surface (141*a*) without support by the second support surfaces (151*a*). When the lower peripheral die seat 22 is in the second angular position (see FIG. 7), the major bottom portion (220*a*) abuts against the major surface portion (141*b*) in the upright direction (D), the abutting protrusions (220*b*) respectively abut against the second support surfaces (151*a*) in the upright direction (D), and the leeway slots 221 are misaligned with the second support surfaces (151*a*) in the upright direction (D) such that the lower peripheral die seat 22 is supported on both the first and second support surfaces (141*a*, 151*a*). The number, shape and arrangement of the first and second support surfaces (141*a*, 151*a*) may be varied as required. For example, the radially extending surface portions (141*c*) of the first support surface (141*a*) may be omitted.

With the first and second support surfaces (141*a*, 151*a*) of the first and second resilient units 14, 15 resiliently supporting the lower peripheral die seat 22, two different resilient supports can be provided to the lower peripheral die seat 22 in the first and second angular positions, respectively. Hence, only one lower die 2 is needed, which reduces the number of component parts of the button badge making machine 100 and thus the manufacturing cost thereof. In this embodiment, when the lower peripheral die seat 22 is in the second angular position, the lower peripheral die seat 22 is supported by the first and second support surfaces (141*a*, 151*a*) so as to further enlarge the resilient support. Therefore, the second biasing members 152 may be the springs with a spring constant similar to that of the first biasing members 142 to lower the manufacturing cost. Moreover, when the lower peripheral die seat 22 is in the first angular position, the major bottom portion (220*a*) and the abutting protrusions (220*b*) respectively abut against the major surface portion (141*b*) and the radially extending surface portions (141*c*). More particularly, the abutting protrusions (220*b*) are misaligned with the second support surfaces (151*a*), and the first support surface (141*a*) of the first support protrusion 141 is permitted to be pressed downward into the lower support member 12. Thus, the lower peripheral die seat 22 is capable of being resiliently moved downwardly into the lower support member 12 in the first angular position. When the lower peripheral die seat 22 is in the second angular position, the major bottom portion (220*a*) abuts against the major surface portion (141*b*), and the abutting protrusions (220*b*) are misaligned with the radially extending surface portions (141*c*) and respectively abut against the second support surfaces (151*a*) such that the downward movement of the lower peripheral die seat 22 is stopped when the abutting protrusions (220*b*) abut against the upper surface 122 of the lower support member 12. Thus, a maximum amount of the downward movement of the lower peripheral die seat 22 in the first angular position is different from that of the downward movement of the lower peripheral die seat 22 in the second angular position. That is, the maximum amount of the downward resilient movement in the first angular position is larger than that of the downward resilient movement in the second angular position.

In a modified embodiment, the first and second support surfaces (141*a*, 151*a*) may have different heights such that the maximum amounts of the downward movements of the lower peripheral die seat 22 in the first and second angular positions are different. In another modified embodiment, two stop protrusions with different heights may be disposed on the lower support member 12 for abutment of the lower peripheral die seat 22 to respectively limit the downward movements of the lower peripheral die seat 22 in the first and second angular positions so as to make the maximum amounts of the downward movements of the lower peripheral die seat 22 in the first and second angular positions different. Furthermore, the configurations of the first support surface (141*a*) and the bottom of the lower peripheral die seat 22 may be varied as required to permit the lower peripheral die seat 22 to be pressed into the lower support member 12 when the lower peripheral die seat 22 is in the first angular position.

Figure 14:
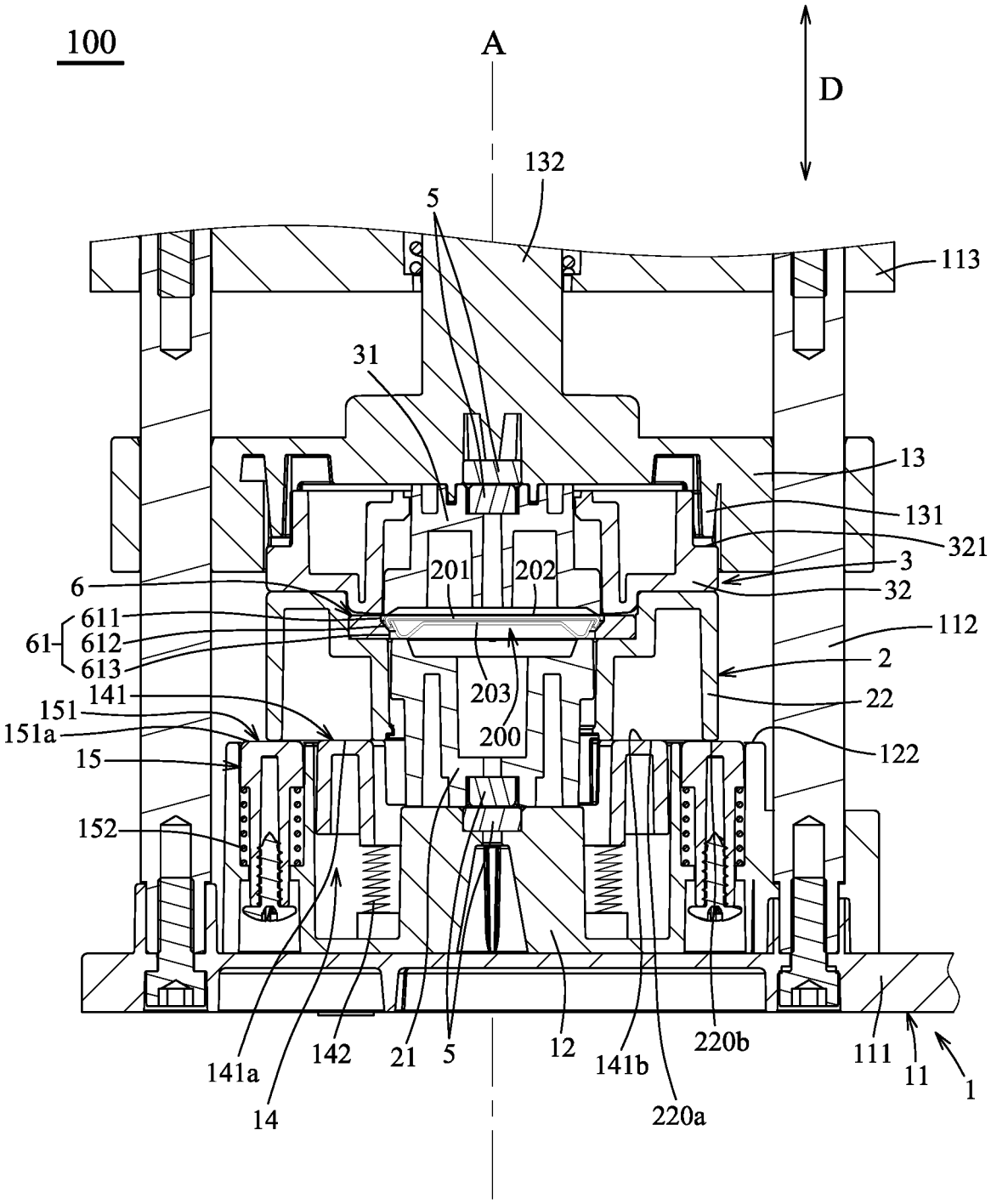

Referring to FIGS. 1, 2, 3 and 7, the upper die 3 cooperates with the lower die 2 to press and make the button badge 200 (see FIG. 14). The upper die 3 includes an upper center die seat 31 which is disposed on and movable with the upper pressing member 13 and which is correspondingly located above the lower center die seat 21, and an upper peripheral die seat 32 which surrounds and is movable relative to the upper center die seat 31 in the upright direction (D) and which is correspondingly located above the lower peripheral die seat 22. The upper peripheral die seat 32 is revolvable relative to the upper pressing member 13 about the rotating axis (A) between a third angular position (see FIG. 1) and a fourth angular position (see FIG. 7). When the upper peripheral die seat 32 is in the third angular position, the upper peripheral die seat 32 corresponds with the lower peripheral die seat 22 in the first angular position and is movable with the upper center die seat 31 downwardly toward the lower peripheral die seat 22 to perform the first making step. When the upper peripheral die seat 32 is in the fourth angular position, the upper peripheral die seat 32 corresponds with the lower peripheral die seat 22 in the second angular position to perform the second making step.

Referring to FIGS. 3, 4, 8 and 9, the upper pressing member 13 is formed with a plurality of sliding protrusions 131 which project downwardly to the upper peripheral die seat 32. The upper peripheral die seat 32 has an upper seat wall 320 which faces upwardly, and a plurality of sliding grooves 321 which extend downwardly from the upper seat wall 320. When the upper peripheral die seat 32 is in the third angular position (see FIG. 4), the sliding protrusions 131 abut against the upper seat wall 320 to move the upper peripheral die seat 32 downwardly with the upper center die seat 31 and to avoid upward movement of the upper peripheral die seat 32 relative to the upper center die seat 31. When the upper peripheral die seat 32 is in the fourth angular position (see FIG. 8), the sliding protrusions 131 are respectively aligned with the sliding grooves 321 so as to permit movement of the upper peripheral die seat 32 relative to the upper pressing member 13 and the upper center die seat 31 in the upright direction (D) through the engagement of the sliding protrusions 131 in the sliding grooves 321. It is noted that one sliding protrusion 131 and one sliding groove 321 may be used instead.

Referring to FIGS. 1, 2, 3 and 6, in this embodiment, the lower die 2 is removably connected with the lower support member 12, and the upper die 3 is removably connected with the upper pressing member 13. For example, magnetically attractive members 5, such as a magnet and a magnetically attractive metal, are respectively disposed on the lower center die seat 21 and the lower support member 12 such that the lower die 2 and the lower support member 12 are in magnetically attractive engagement with each other. Furthermore, magnetically attractive members 5, such as a magnet and a magnetically attractive metal, are respectively disposed on the upper center die seat 31 and the upper pressing member 13 such that the upper die 3 and the upper pressing member 13 are in magnetically attractive engagement with each other. Thus, the upper and lower dies 2, 3 are replaceable for making a variety shapes or sizes of button badges 200. Alternatively, other snap fitting structures may be disposed to removably connect the upper and lower center die seats 31, 21 to the upper and lower support members 13, 12. Still alternatively, the upper and lower center die seats 31, 21 may be fixedly connected to the upper and lower support members 13, 12. Moreover, in this embodiment, the lower peripheral die seat 22 is turnable relative to the lower center die seat 21 about the rotating axis (A) so as to revolve relative to the lower support member 12 between the first and second angular positions. The upper peripheral die seat 32 is turnable relative to the upper center die seat 31 about the rotating axis (A) so as to revolve relative to the upper pressing member 13 between the third and fourth angular positions. In a modified embodiment, the lower die 2 is entirely revolvable relative to the lower support member 12 about the rotating axis (A), and the upper die 3 is entirely revolvable relative to the upper pressing member 13 about the rotating axis (A).

Referring to FIG. 5, in this embodiment, the lower support member 12 is rotatable around the upright post 112 to facilitate replacement of the upper and lower dies 3, 2 and placement of the component parts of the button badge 200 on the lower die 2.

Figure 6:
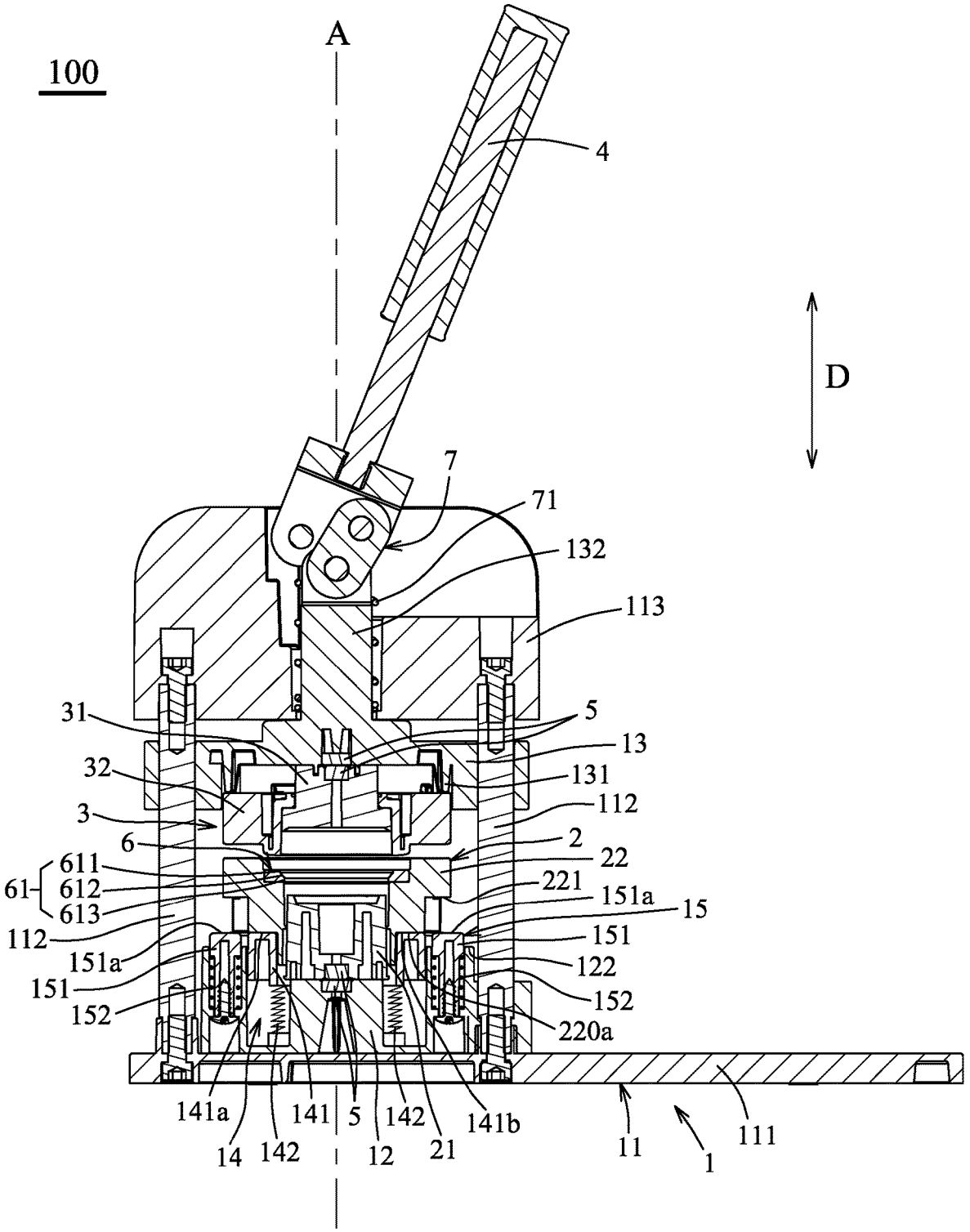
FIG. 6 is a sectional view of the embodiment.
Figure 7:
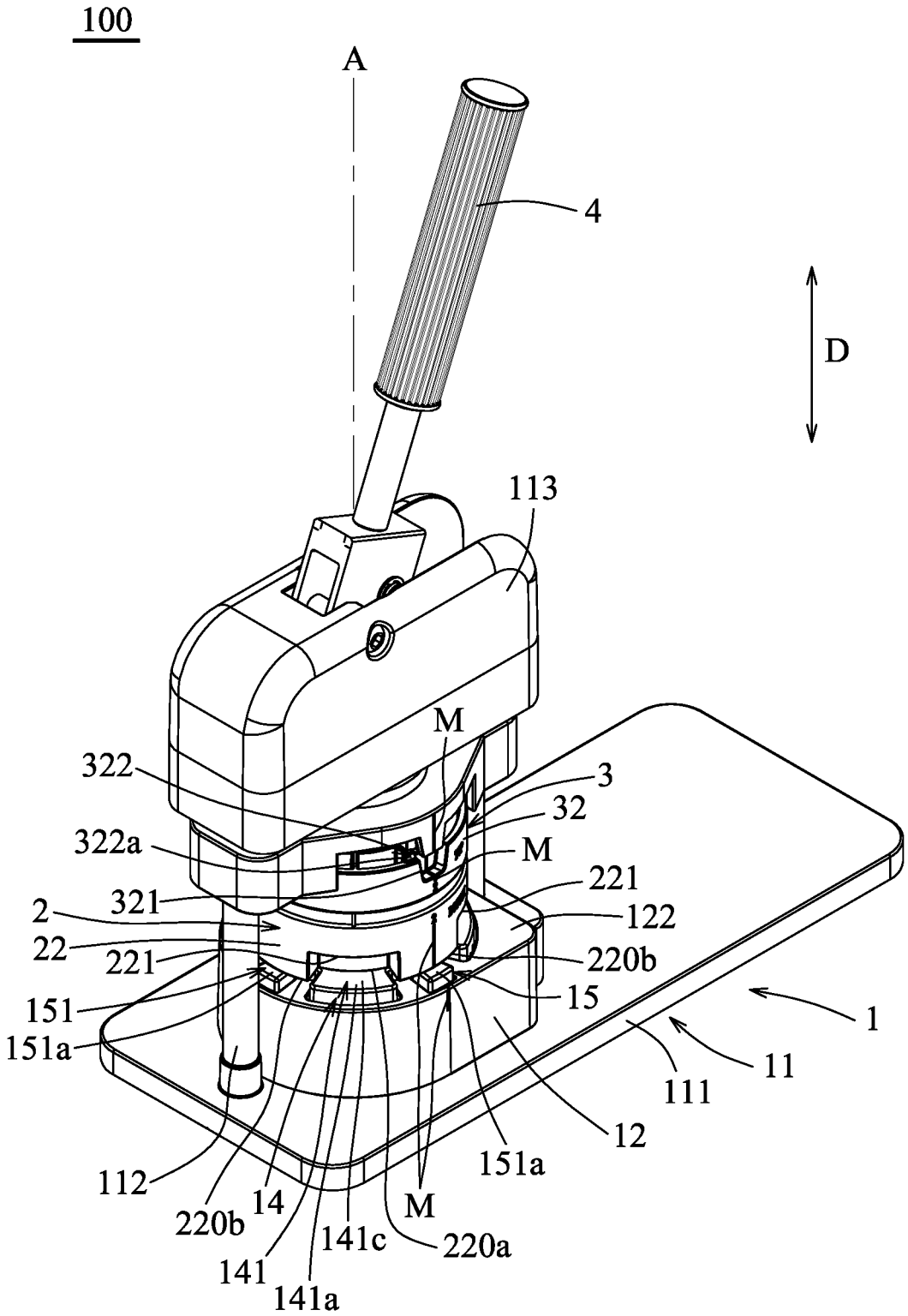
FIG. 7 is a perspective view of the embodiment, in a state where the lower peripheral die seat is in a second angular position and the upper peripheral die seat is in a fourth angular position.
Figure 10:
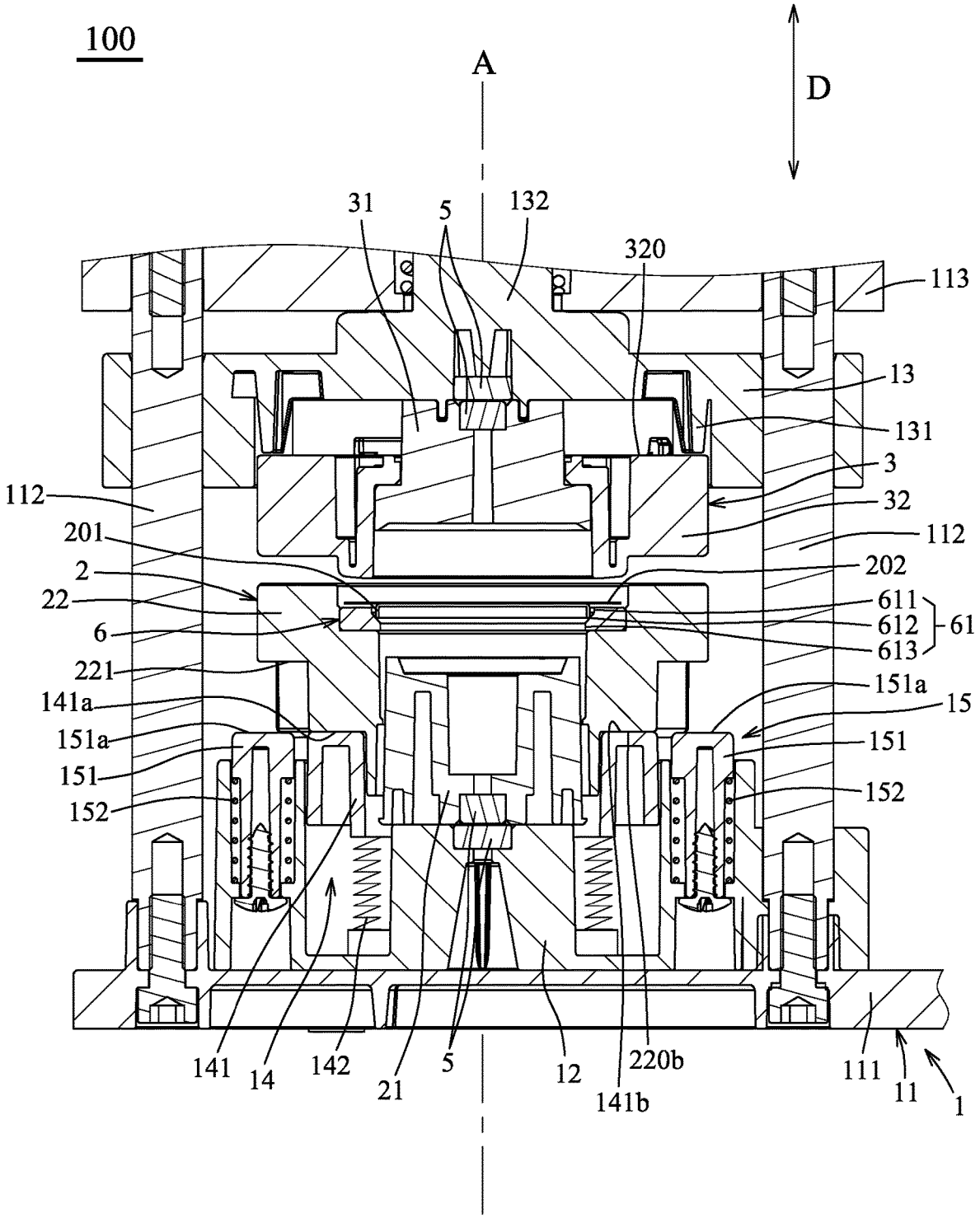
FIGS. 10 and 11 are fragmentary sectional views illustrating the embodiment when performing a first making step.

Referring to FIGS. 2, 6 and 10, in this embodiment, the upper and lower dies 3, 2 are mainly made from a plastic material. The lower peripheral die seat 22 has a ring carrier 6 which is disposed on an upper end thereof for carrying the upper body 201 and the pattern layer 202 of the button badge 200. The ring carrier 6 is made from a metal material. The upper and lower dies 3, 2 mainly made from a plastic material can reduce the manufacturing cost and weight of the machine 100. The ring carrier 6 made from a metal material can bear a pressing force during the badge making processes. The ring carrier 6 has an inner peripheral surface 61 which surrounds the rotating axis (A) and which includes an upright surface section 611 extending in the upright direction (D), a converged surface section 612 converged from the upright surface section 611 toward the rotating axis (A), and a lower surface section 613 extending downwardly from the converged surface section 612 in the upright direction (D). The upper body 201 is positioned by the upright surface section 611, and the pattern layer 202 is pressed and riveted on the upper body 201 by the converged surface section 612.

Additionally, the upper peripheral die seat 32 has two limiting block assemblies 322 projecting upwardly of the upper seat wall 320 and each having two limiting blocks (322*a*) such that the limiting blocks (322*a*) laterally abut against the corresponding sliding protrusions 131 when the upper peripheral die seat 32 is turned to the third angular position (see FIG. 4) and the fourth angular position (see FIG. 8) so that the upper peripheral die seat 32 is restricted to the third angular position and the fourth angular position. Moreover, the lower center die seat 21 has a plurality of positioning holes 211 formed in a lower portion thereof. The lower support member 12 has a plurality of positioning blocks 121 engageable in the positioning holes 211, respectively, so as to restrict rotation of the lower center die seat 21 relative to the lower support member 12. Furthermore, the lower center die seat 21 and the lower peripheral die seat 22 respectively have engaging portions (not shown) interengageable with each other so that the lower peripheral die seat 22 is restricted to the first angular position and the second angular position. Alternatively, each of the lower support member 12, the lower peripheral die seat 22, the upper pressing member 13 and the upper peripheral die seat 32 may have marks (M) to indicate the rotational angle of the lower and upper peripheral die seats 22, 32.

Referring to FIGS. 1 and 6, the upper pressing member 13 has a driven portion 132 which extends upwardly and into the upper frame portion 113. The handle 4 is disposed on the upper frame portion 113 and is pivoted with the driven portion 132 by means of a pivot mechanism 7 to be operable to move the upper pressing member 13 in the upright direction (D) so as to actuate the upper die 3 downwardly r performing the badge making process. The pivot mechanism 7 has a return spring 71 which is connected with the upper frame portion 113 to bias the handle 4 to return the same back to its initial position.

In the badge making process, the first making step is performed. Referring to FIGS. 4 and 10, when the lower peripheral die seat 22 is in the first angular position and the upper peripheral die seat 32 is in the third angular position, an upper body 201 of a button badge 200 to be made is placed on the ring carrier 6 to have a lower peripheral edge thereof abutting against the converged surface section 612 to be held by the upright surface section 611. Meanwhile, a pattern layer 202 (including a pattern paper (not shown) and a plastic sheet (not shown)) is superimposed upon the upper body 201.

Figure 11:
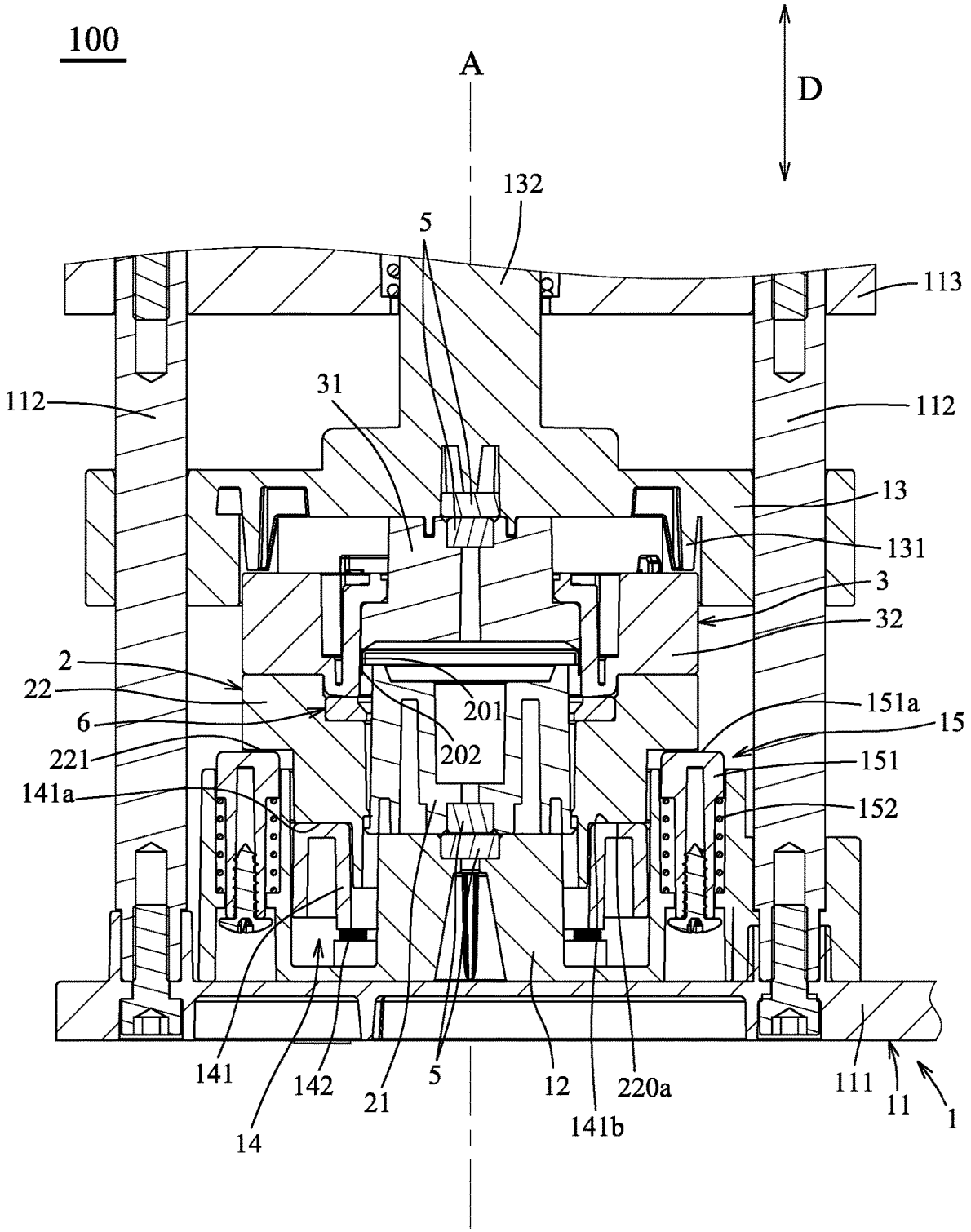

Referring to FIG. 11, the handle 4 is turned (see FIG. 4) to actuate the upper pressing member 13 to move the upper center and peripheral die seats 31, 32 downwardly (the sliding protrusions 131 abut against the upper peripheral die seat 32 at this stage), and the lower peripheral die seat 22 is pressed downwardly. At this time, with the alignment of the abutting protrusions (220*b*) with the radially extending surface portions (141*c*) (see FIG. 1), the lower peripheral die seat 22 and the first support surface (141*a*) are permitted to be resiliently pressed into the lower support member 12 so as to make a maximum amount of the downward movement. The lower center die seat 21 presses and attaches the upper body 201 and the pattern layer 202 together and transfers the assembled upper body 201 and pattern layer 202 into the upper peripheral die seat 32 of the upper die 3 against a first counteracting force generated as a result of a first downward resilient movement of the lower peripheral die seat 22 and the first support surface (141*a*).

Figure 8:
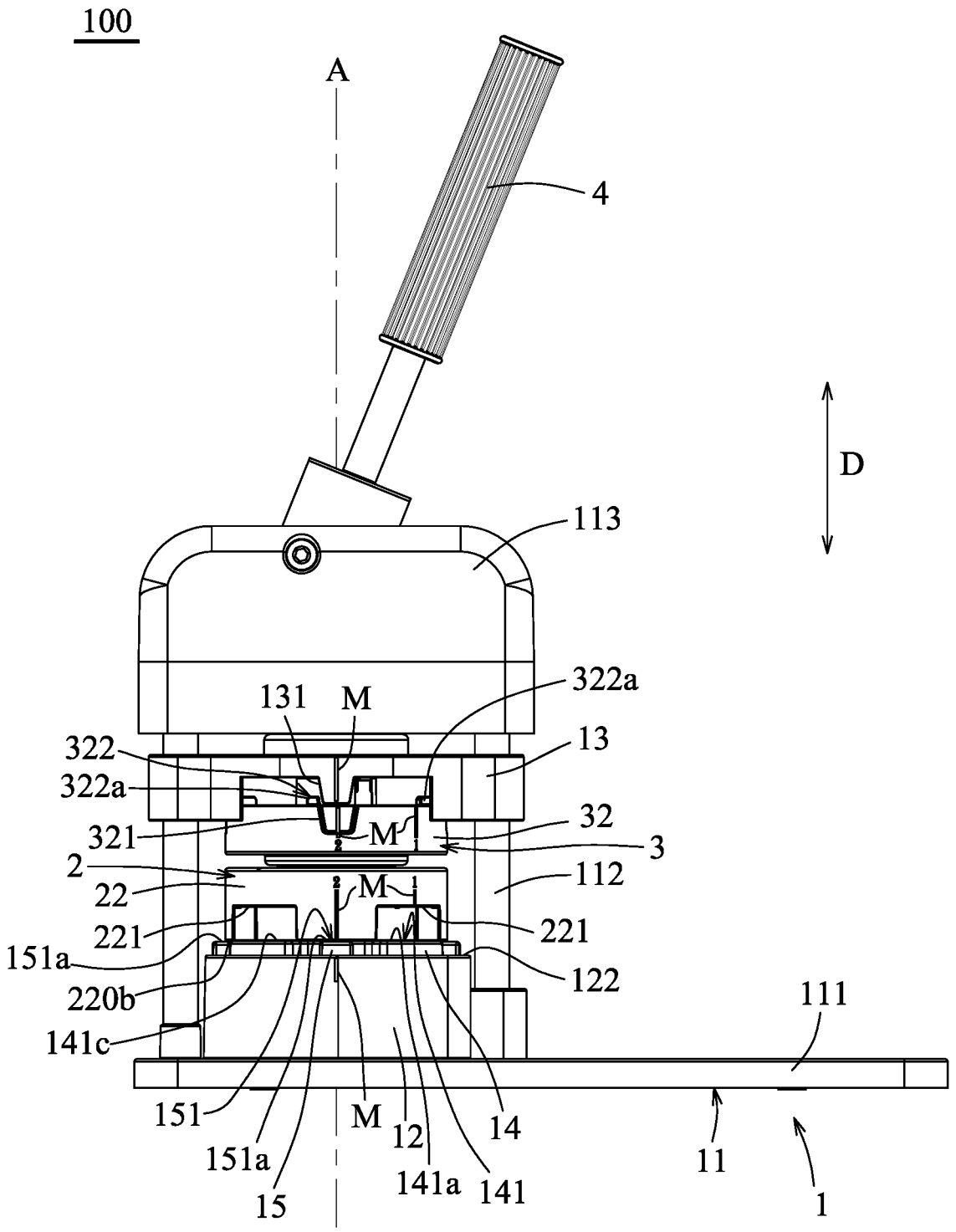
FIG. 8 is a front view of the embodiment in a state similar to FIG. 7.
Figure 12:
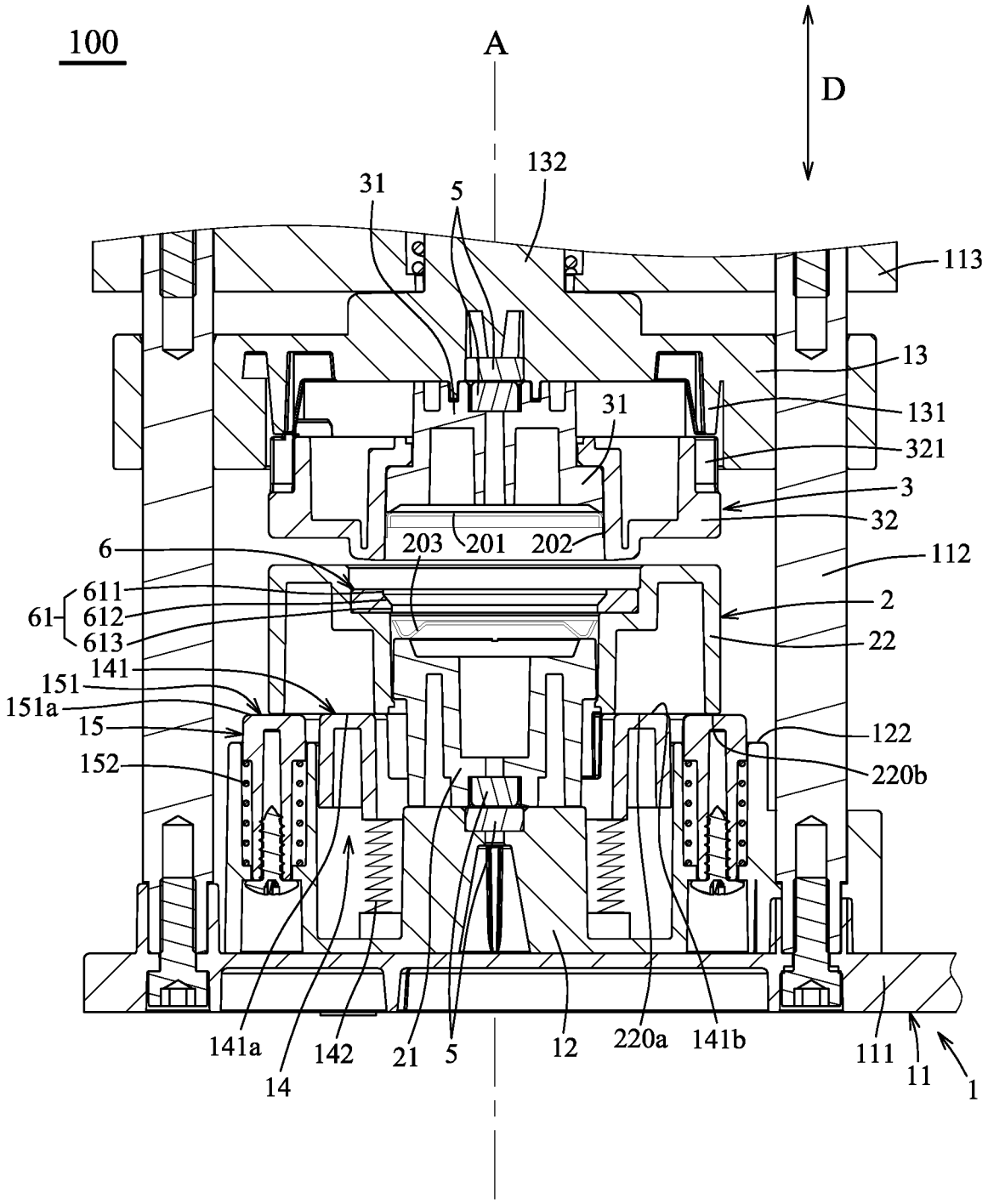
FIGS. 12 to 14 are fragmentary sectional views illustrating the embodiment when performing a second making step.

Referring to FIGS. 8 and 12, subsequently, the second making step is performed. The lower peripheral die seat 22 is turned to the second angular position, and the upper peripheral die seat 32 is turned to the fourth angular position. A lower body 203 is placed on the lower center die seat 21.

Figure 9:
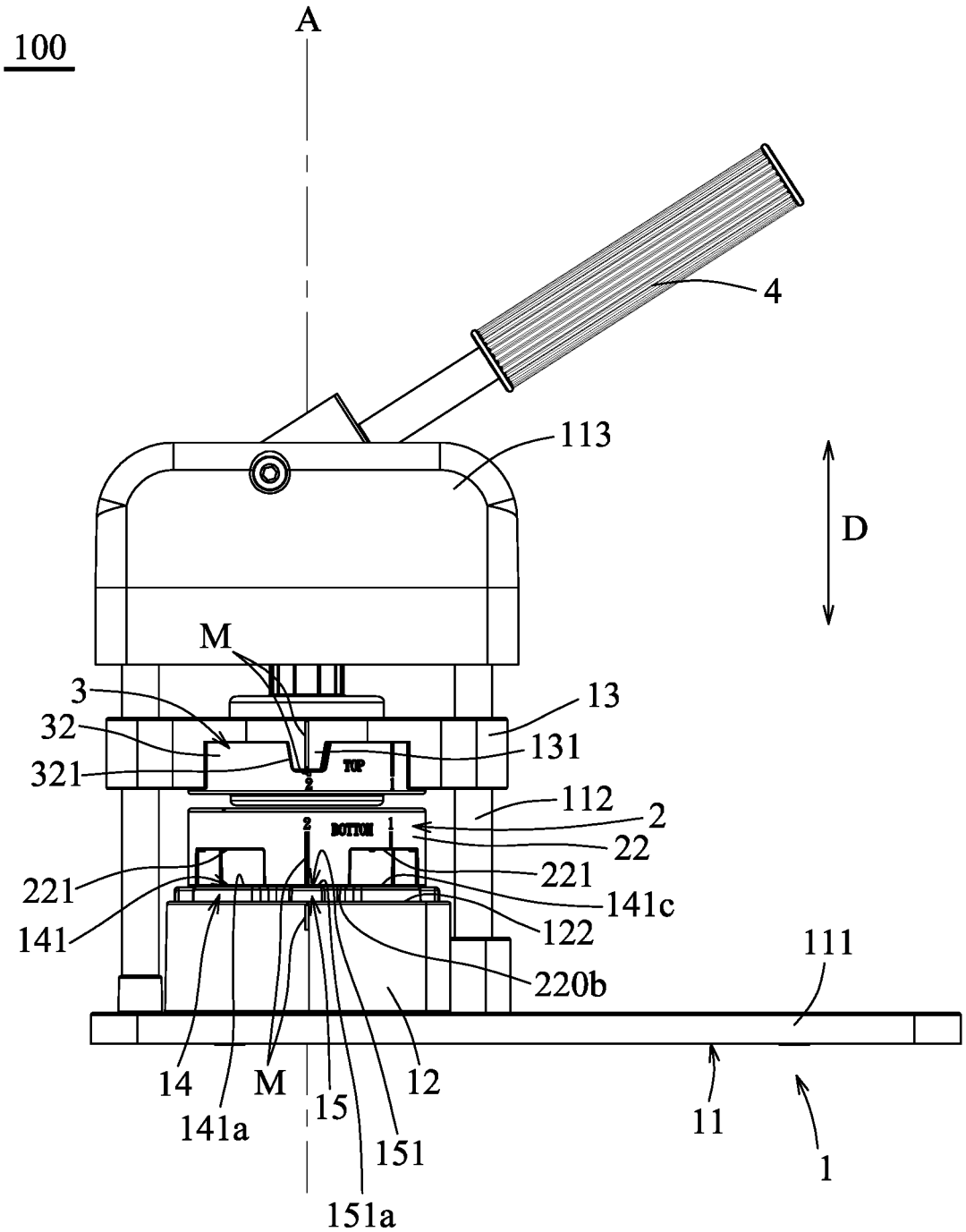
FIG. 9 is a front view similar to FIG. 8, illustrating in a state when a handle is turned downward to move the upper peripheral die seat upwardly relative to an upper center die seat.
Figure 13:
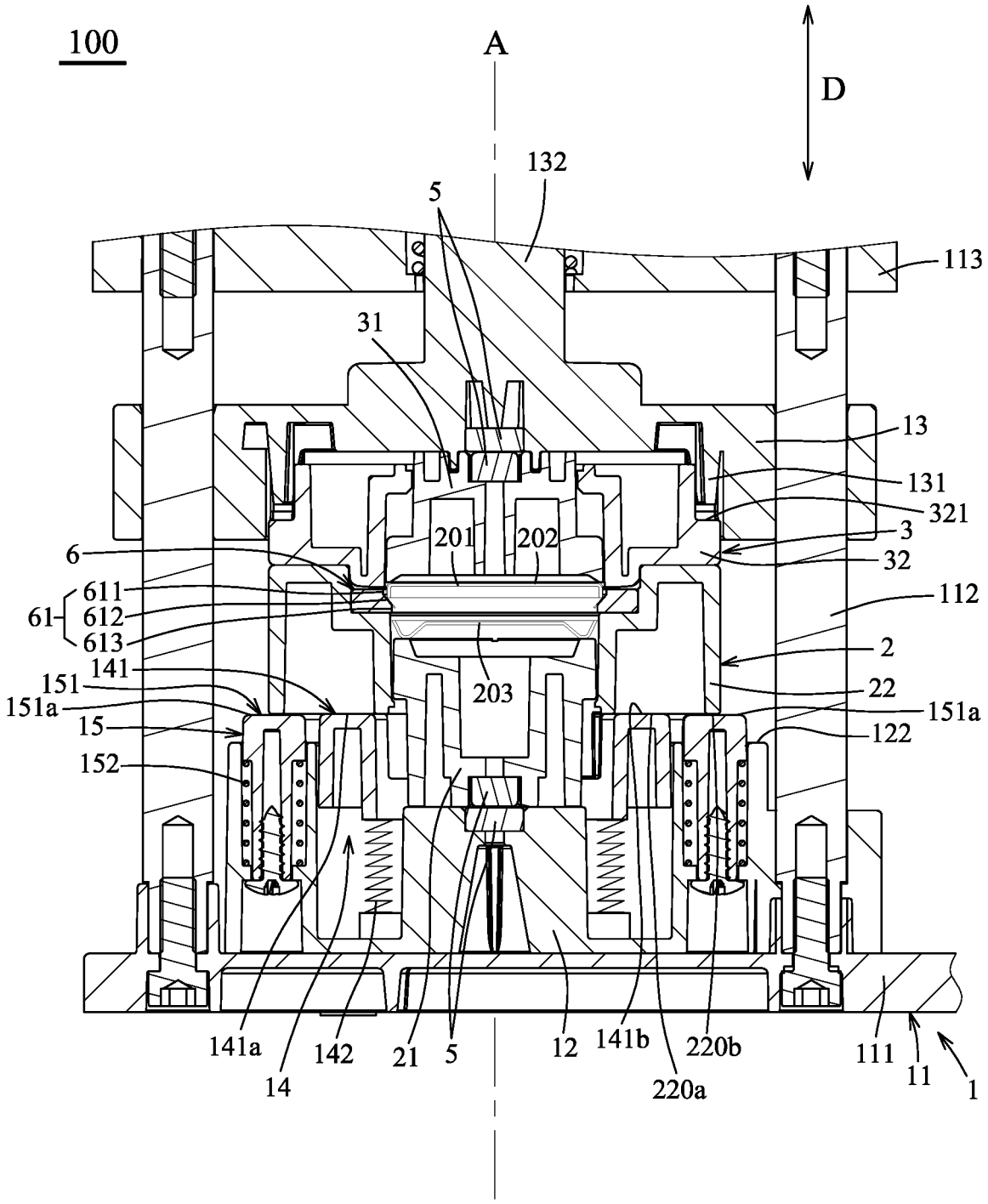

Referring to FIGS. 9 and 13, the handle 4 is turned to actuate the upper pressing member 13 to move the upper center die seat 31 downwardly relative to the upper peripheral die seat 32 (the sliding protrusions 131 are slidably inserted into the sliding grooves 321 at this stage) to perform a removal-and-bent sub-step of the second making step so as to remove the assembled upper body 201 and pattern layer 202 from the upper die 2 back to the ring carrier 6 of the lower peripheral die seat 22. At this stage, the lower rim of the pattern layer 202 is bent inwardly by the converged surface section 612.

Referring to FIG. 14, subsequently, the handle 4 is further turned to move the upper center die seat 31 further downwardly, and the upper peripheral die seat 32 is moved with the upper center die seat 31 downwardly toward the lower peripheral die seat 22 to perform a pressing sub-step of the second making step so as to press the lower peripheral die seat 22 against a second counteracting force that is generated as a result of a second downward resilient movement of the lower peripheral die seat 22 with the first and second support surfaces (141*a*, 151*a*). The downward movement is stopped when the abutting protrusions (220*b*) abut against and are restricted on the upper surface 122 of the lower support member 12. Thus, the maximum amount of the downward resilient movement of the lower peripheral die seat 22 in the second angular position is less than that of the downward resilient movement in the first angular position. At this stage, the lower rim of the pattern layer 202 is curved radially and inwardly, and the upper body 201 is pressed and secured to the lower body 203 to form the button badge 200. It is noted that during the whole remove-and-bent sub-step process, the lower peripheral die seat 22, which is supported by both the first and second support surfaces (141*a*, 151*a*) with a greater support force, is not allowed to be pressed downwardly. As such, contact of the lower body 203 with the assembled upper body 201 and pattern layer 202 before the lower rim of the pattern layer 202 is bent inwardly by the converged surface section 612 can be avoided to prevent pressing failure.

Moreover, the button badge 200 in this embodiment is round in shape. In other embodiments, other shapes (such as rectangular, square, heart shape, etc.) of button badge may be made.

As illustrated, with the first and second support surfaces (141*a*, 151*a*) resiliently supporting the lower peripheral die seat 22 in the first and second angular positions, respectively, the required resilient supports for supporting the lower peripheral die seat 22 in the two making steps can be provided. Moreover, with the positional differences of the abutting protrusions (220*b*) of the lower peripheral die seat 22 in the first and second angular positions, the maximum amounts of the downward movement of the lower peripheral die seat 22 in the first and second angular positions are different. Hence, only one lower die 2 is disposed for making a button badge 200. The button badge making machine has a fewer number of components, thereby reducing the manufacturing cost. Furthermore, the replacement cost of the dies 2, 3 for different shapes and sizes of button badges is thus greatly reduced not only due to the reduction of the lower dies, but also due to the reduction of the slide seat underneath the two lower dies and the resilient unit for each lower die. Besides, the replacement operation is convenient to conduct.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A button badge making machine adapted to make a button badge, the button badge including an upper body, a pattern layer and a lower body, the button badge making machine comprising:

a support frame including a lower support member, an upper pressing member which is disposed above and movable relative to said lower support member in an upright direction, and a first resilient unit and a second resilient unit which extend in the upright direction and project upwardly from said lower support member, said first resilient unit having at least one first support surface which faces upwardly, said second resilient unit having at least one second support surface which faces upwardly, said first and second support surfaces being resiliently movable downwardly relative to said lower support member;

a lower die including a lower center die seat which is disposed and supported on said lower support member, and a lower peripheral die seat which surrounds and is movable relative to said lower center die seat in the upright direction for the upper body and the pattern layer to be placed thereon in beginning of a first making step, said lower center die seat being adapted for the lower body to be placed thereon in a second making step, said lower peripheral die seat being turnable relative to said lower support member about a rotating axis between a first angular position, where said lower peripheral die seat is engaged with and supported on said first support surface, and a second angular position, where said lower peripheral die seat is engaged with and supported on said second support surface; and an upper die cooperating with said lower die to press and make the button badge, said upper die including an upper center die seat which is disposed on and movable with said upper pressing member and which is correspondingly located above said lower center die seat, and an upper peripheral die seat which surrounds and is movable relative to said upper center die seat in the upright direction and which is correspondingly located above said lower peripheral die seat, said upper peripheral die seat being turnable relative to said upper pressing member about the rotating axis between a third angular position, where said upper peripheral die seat corresponds with said lower peripheral die seat in the first angular position and is movable with said upper center die seat downwardly toward said lower peripheral die seat to perform the first making step so as to press the upper body and the pattern layer together and transfer the upper body and the pattern layer into said upper die against a first counteracting force generated as a result of a first downward resilient movement of said lower peripheral die seat and said first support surface, and a fourth angular position, where said upper peripheral die seat corresponds with said lower peripheral die seat in the second angular position, and is movable relative to said upper center die seat in the upright direction to permit a downward movement of said upper center die seat and said upper pressing member relative to said upper peripheral die seat to perform a removal sub-step of the second making step so as to remove the upper body and the pattern layer from said upper die back to said lower peripheral die seat, and where said upper peripheral die seat is movable with said upper center die seat downwardly toward said lower peripheral die seat to perform a pressing sub-step of the second making step so as to press said lower peripheral die seat against a second counteracting force that is generated as a result of a second downward resilient movement of said lower peripheral die seat with said second support surface, a maximum amount of the first downward resilient movement of said lower peripheral die seat in the first angular position is larger than that of the second downward resilient movement of said lower peripheral die seat in the second angular position.

2. The button badge making machine as claimed in claim 1, wherein said lower peripheral die seat and said first support surface are resiliently movable downward into said lower support member when said lower peripheral die seat is in the first angular position.

3. The button badge making machine as claimed in claim 1, wherein said upper pressing member is formed with at least one sliding protrusion which projects downwardly to said upper peripheral die seat, said upper peripheral die seat having an upper seat wall which faces upwardly, and at least one sliding groove which extends downwardly from said upper seat wall such that, when said upper peripheral die seat is in the third angular position, said sliding protrusion abuts against said upper seat wall to move said upper peripheral die seat downwardly with said upper center die seat, and such that, when said upper peripheral die seat is in the fourth angular position, said sliding protrusion is aligned with said sliding groove so as to be slidably inserted into said sliding groove when said upper pressing member is moved downwardly to perform a removal-and-bent sub-step.

4. The button badge making machine as claimed in claim 1, wherein said lower peripheral die seat is turnable relative to said lower center die seat about the rotating axis so as to turn relative to said lower support member between the first and second angular positions, said upper peripheral die seat being turnable relative to said upper center die seat about the rotating axis so as to turn relative to said upper pressing member between the third and fourth angular positions.

5. The button badge making machine as claimed in claim 1, wherein said lower center die seat is removably connected with said lower support member, and said upper center die seat is removably connected with said upper pressing member.

6. The button badge making machine as claimed in claim 5, wherein said lower center die seat and said lower support member are in magnetically attractive engagement with each other, and said upper center die seat and said upper pressing member are in magnetically attractive engagement with each other.

7. The button badge making machine as claimed in claim 1, wherein said lower peripheral die seat is engaged with and supported on said first support surface when said lower peripheral die seat is in the second angular position.

8. The button badge making machine as claimed in claim 1, wherein said support frame further includes a base plate, an upper frame portion disposed above said base plate, and a plurality of upright posts each extending in the upright direction and interconnecting said base plate and said upper frame portion, said lower support member being rotatably journalled on one of said upright posts, said upper pressing member being slidably disposed on said upright posts.

9. The button badge making machine as claimed in claim 8, wherein said upper pressing member has a driven portion which extends upwardly and into said upper frame portion, said button badge making machine further comprising a handle which is disposed on said upper frame portion and pivoted with said driven portion to be operable to press said upper pressing member.

10. The button badge making machine as claimed in claim 1, wherein said lower peripheral die seat has a ring carrier which is disposed on an upper end thereof for carrying the upper body and the pattern layer, said ring carrier being made from a metal material.

11. The button badge making machine as claimed in claim 10, wherein said ring carrier has an inner peripheral surface which surrounds the rotating axis and which includes an upright surface section extending in the upright direction, and a converged surface section converged from said upright surface section toward the rotating axis.

* * * * *